US007226900B2

(12) United States Patent
Delplancke et al.

(10) Patent No.: US 7,226,900 B2
(45) Date of Patent: Jun. 5, 2007

(54) LIQUID LAUNDRY DETERGENT COMPOSITION CONTAINING BORON-COMPATIBLE CATIONIC DEPOSITION AIDS

(75) Inventors: Patrick Firmin August Delplancke, Laarne (BE); Jean-Pol Boutique, Gembloux (BE); Stefano Scialla, Rome (IT); Mark Robert Sivik, Mason, OH (US); Bernard William Kluesener, Harrison, OH (US); Jiping Wang, West Chester, OH (US)

(73) Assignee: The Proctor & Gamble Company, Cincinnati, OH (US)

( * ) Notice: Subject to any disclaimer, the term of this patent is extended or adjusted under 35 U.S.C. 154(b) by 428 days.

(21) Appl. No.: 10/867,047

(22) Filed: Jun. 14, 2004

(65) Prior Publication Data

US 2004/0266653 A1 Dec. 30, 2004

Related U.S. Application Data

(60) Provisional application No. 60/478,795, filed on Jun. 16, 2003.

(51) Int. Cl.

| | |
|---|---|
| ***C11D 1/00*** | (2006.01) |
| ***C11D 3/22*** | (2006.01) |
| ***C11D 3/386*** | (2006.01) |
| ***C11D 9/16*** | (2006.01) |
| ***D06L 1/00*** | (2006.01) |

(52) U.S. Cl. ..... 510/470; 510/276; 510/302; 510/320; 510/330; 510/392; 510/473; 510/475; 8/137

(58) Field of Classification Search ..... 510/276, 510/302, 320, 330, 392, 470, 473, 475; 8/137
See application file for complete search history.

(56) References Cited

U.S. PATENT DOCUMENTS

| | | | | |
|---|---|---|---|---|
| 5,723,426 | A | 3/1998 | Zhen et al. | |
| 2002/0045562 | A1 * | 4/2002 | Moe et al. | 510/474 |

FOREIGN PATENT DOCUMENTS

| | | | |
|---|---|---|---|
| WO | WO 94/03152 | | 2/1994 |
| WO | WO 98/18828 | | 5/1998 |
| WO | WO 99/14295 | * | 3/1999 |
| WO | WO 2004/022686 A1 | | 3/2004 |

* cited by examiner

*Primary Examiner*—Brian Mruk
(74) *Attorney, Agent, or Firm*—Armina E. Matthews; Julie A. McConihay; Kim William Zerby

(57) ABSTRACT

The invention is directed to liquid laundry detergent compositions comprising (a) at least one surfactant; (b) at least one enzyme and an enzyme stabilizing system comprising boron; (c) at least one fabric care ingredient which is not a fabric cleaning ingredient; and (d) at least one modified cationic polysaccharide-based deposition aid for the fabric care ingredient, wherein prior to modification, the cationic deposition aid contains at least one pair of cis-hydroxy groups, and wherein the cationic deposition aid is modified in such a way that the enzyme stabilizing system does not exhibit cis-hydroxy group interaction with the cationic deposition aid. The use of such compositions and methods for treating fabrics in fabric treatment applications including domestic laundering to thereby provide improved cleaning and fabric care are also covered.

22 Claims, No Drawings

LIQUID LAUNDRY DETERGENT COMPOSITION CONTAINING BORON-COMPATIBLE CATIONIC DEPOSITION AIDS

CROSS REFERENCE TO RELATED APPLICATIONS

This application claims the benefit of U.S. Provisional Application No. 60/478,795 filed Jun. 16, 2003.

FIELD OF THE INVENTION

The invention relates to liquid laundry detergent compositions comprising surfactants, enzymes, enzyme-stabilizing systems, additional fabric care ingredients and boron-compatible cationic deposition aids. The invention also relates to the use of such liquid laundry detergent compositions and to methods for treating fabrics in fabric treatment applications including domestic laundering to thereby provide improved cleaning and fabric care.

BACKGROUND OF THE INVENTION

When consumers launder fabrics, they desire not only excellence in cleaning, they also seek to impart superior fabric care benefits. Such care effects can be exemplified by one or more of reduction of wrinkles benefits; removal of wrinkles benefits; prevention of wrinkles benefits; fabric softness benefits; fabric feel benefits; garment shape retention benefits; garment shape recovery benefits; elasticity benefits; ease of ironing benefits; perfume benefits; color care benefits; anti-abrasion benefits; anti-pilling benefits; or any combination thereof. Compositions which provide both cleaning and fabric care benefits, e.g., fabric softening benefits, are known as "2 in 1"-detergent compositions and/or as "softening through the wash"-compositions.

Over the last couple of decades, a significant increase in cleaning performance has been achieved by adding enzymes into detergent compositions. There are different sorts of enzymes available and suitable for incorporation into detergent compositions dependent on the nature of the stain(s) to be removed. Furthermore, dependent on the form of the detergent composition, being either a granular product or a liquid, enzyme-stabilizing systems are needed to prevent enzyme degradation. In liquid laundry detergent compositions, enzymes are typically stabilized either by organic or inorganic acids. A typical example for an organic acid would be short chain carboxylic acids, e.g., formic acid. A typical example of an inorganic acid would be boric acid. Furthermore, salts of these acids can also be used, such as alkali salts of boric acids, e.g. sodium borate and others.

Another development over the last couple of years relates to the means of enhancing additional fabric care benefits, which are different from pure fabric cleaning benefits. Examples of these additional fabric care benefits are, e.g., fabric softening benefits, and color care benefits. The common feature of these fabric care benefits is that a fabric care agent needs to be deposited to a fabric. Due to the wash and/or rinse conditions, the deposition characteristics of such agents is not very high so that the amount deposited is not very high. In order to enhance the deposition characteristics of such fabric care agents, deposition aids have been added to such compositions. Examples of deposition aids suitable to enhance the deposition of fabric care agents are for example, cationic compounds, such as poly-quaternized ammonium compounds and cationic polysaccharides, e.g, cationic guar gums.

In order to have both superior cleaning performance, and excellent fabric care performance, it is desirable to formulate detergent compositions which combine an enhanced cleaning effect, driven by incorporation of enzymes, and very good fabric care effect, driven by incorporation of deposition aids for additional fabric care agents. However, it has now been observed when formulating liquid laundry detergent compositions providing cleaning and additional fabric care benefits, like reduction of wrinkles benefits; removal of wrinkles benefits; prevention of wrinkles benefits; fabric softness benefits; fabric feel benefits; garment shape retention benefits; garment shape recovery benefits; elasticity benefits; ease of ironing benefits; perfume benefits; color care benefits; anti-abrasion benefits; anti-pilling benefits; or any combination thereof, that enzyme-containing detergent compositions which contain a boron-based enzyme-stabilization system, and a cationic deposition aid tend to encounter a stability problem. This stability problem appears in the formation of beads formed from interacting components. Such bead formation can, in turn, lead to a precipitation within the fully-formulated detergent product. It has been found that the precipitate consists of certain components of the composition. These components have been identified to be a complex of the boron-based enzyme-stabilization system, and the cationic deposition aid. The precipitate remains undissolved even after shaking or warming of the composition.

Without being bound by theory, it is believed that this stability problem occurs due to an incompatibility of the boron-based enzyme-stabilization system and the cationic deposition aid, such as cationic polysaccharide-based deposition aids, e.g., cationic guar gums. It is believed that the formation of beads occurs due to an interaction of the boron-based enzyme stabilizing system with the cationic polysaccharide-based deposition aid, for example, with the cationic guar gum. It is further believed that this interaction occurs because of the affinity of boron to oxygen which could indeed manifest it in a reaction between the cationic polysaccharide-based deposition aid containing many sources of oxygen, e.g., hydroxy groups, ether groups, and the boron-based enzyme-stabilizing system, for example, in a boric acid- and/or borate-containing enzyme-stabilizing system. Without being bound by theory, it is believed that this interaction mainly takes place between oxygen atoms of two cis-orientated hydroxy groups (i.e., 1,2-cis-hydroxy groups) of the guar gum saccharide moiety and the boron atom.

The consequence of this bead formation is a drastic loss in fabric care performance, because the guar gum molecules which are then bound to the boron-based enzyme stabilizing system are not available to work as a deposition aid any more. Another consequence may be a loss in fabric cleaning performance occurred due to degradation of enzymes which aren't stabilized sufficiently any more, since the boron-based stabilizing system interacting with the guar gum does not suitable function as a enzyme stabilizer any more.

The present invention overcomes such incompatibility problems of cationic polysaccharide-based deposition aids, for example, cationic guar gums, and boron-based, for example, boric acid- and/or borate-containing, enzyme stabilizing systems. It is therefore an object of the present invention to provide liquid laundry detergent compositions comprising enzymes, suitable enzyme-stabilizing systems based on boron compounds like boric acid and/or borate which do not exhibit interaction with cationic polysaccharide-based deposition aids such as cationic guar gums.

Another object of the present invention is to secure superior fabric cleaning and superior fabric care.

One embodiment of the present invention is a liquid laundry detergent composition comprising (a) at least one surfactant; (b) at least one enzyme and a boron-based enzyme stabilizing system comprising, for example, boric acid and/or salts thereof; (c) at least one fabric care ingredient which is not a fabric cleaning ingredient; and (d) at least one cationic polysaccharide-based deposition aid for the fabric care ingredient, wherein the cationic deposition aid does not exhibit interaction with the boron-based enzyme stabilizing system to provide both excellent fabric cleaning and superior fabric care.

It has now surprisingly been found that the incompatibility of the boron-based, for example, boric acid- and/or borate-containing, enzyme stabilizing systems and polysaccharide-based guar gums can be avoided when the interaction between these two groups is prevented. This can be achieved by modification of the polysaccharide-based deposition aid, for example, of the guar gum. By modification it is meant that the hydroxy groups of such cationic guar gums are substituted with chemical groups so that the interaction with a boron-based enzyme-stabilization system is prevented.

SUMMARY OF THE INVENTION

The present invention relates to liquid, laundry detergent compositions comprising (a) at least one surfactant selected from the group consisting of anionic surfactants, zwitterionic surfactants, amphoteric surfactants, nonionic surfactants, cationic surfactants, and mixtures thereof;

(b) at least one enzyme and an enzyme stabilizing system comprising boron, preferably a enzyme stabilizing system comprising boric acid and/or salts thereof;

(c) at least one fabric care ingredient which is not a fabric cleaning ingredient; and (d) at least one modified cationic polysaccharide-based deposition aid for the fabric care ingredient, wherein prior to modification, the cationic deposition aid contains at least one pair of cis-hydroxy groups, and wherein the cationic deposition aid is modified in such a way that the enzyme stabilizing system does not exhibit cis-hydroxy group interaction with the cationic deposition aid.

The invention further includes the use of such liquid laundry detergent compositions to impart fabric cleaning benefits and fabric care benefits to a fabric substrate.

The present invention is further directed to a method for treating a substrate. This method comprises contacting the substrate with the liquid laundry detergent composition of the present invention such that the substrate is treated.

The present invention also includes methods for providing fabric softening benefits, anti-abrasion benefits, anti-pilling benefits or any combination thereof to fabrics which have been treated with the liquid laundry detergent compositions of the present invention.

DETAILED DESCRIPTION OF THE INVENTION

A, Surfactants—The present compositions comprise as one essential component at least one surfactant selected from the group consisting of anionic surfactants, zwitterionic surfactants, amphoteric surfactants, nonionic surfactants, cationic surfactants, and mixtures thereof. By nature, any surfactant known in the art of detergent compositions may be used, such as disclosed in (1) "Surfactant Science Series", Vol. 7, edited by W. M. Linfield, Marcel Dekker and in (2) "Surface—Active Agents & Detergents", Volumes I and II, by Schwatz, Perry and Berch. Suitable levels of this component are in the range from 1.0% to 80%, preferably from 5.0% to 65%, more preferably from 10% to 50% by weight of the composition.

(a1) Anionic Surfactants—The compositions of the invention may comprise an anionic surfactant. The compositions of the present invention comprise preferably at least one sulphonic acid surfactant, such as a linear alkyl benzene sulphonic acid, but water-soluble salt forms may also be used. Anionic surfactant(s) are typically present at a level of from 1.0% to 70%, preferably from 5.0% to 50% by weight, and more preferably from 10% to 30% by weight of the composition.

Anionic sulfonate or sulfonic acid surfactants suitable for use herein include the acid and salt forms of $C_5$–$C_{20}$, more preferably $C_{10}$–$C_{16}$, more preferably $C_{11}$–$C_{13}$ alkylbenzene sulfonates, $C_5$–$C_{20}$ alkyl ester sulfonates, $C_6$–$C_{22}$ primary or secondary alkane sulfonates, $C_5$–$C_{20}$ sulfonated polycarboxylic acids, and any mixtures thereof, but preferably $C_{11}$–$C_{13}$ alkylbenzene sulfonates.

Anionic sulphate salts or acids surfactants suitable for use in the compositions of the invention include the primary and secondary alkyl sulphates, having a linear or branched alkyl or alkenyl moiety having from 9 to 22 carbon atoms or more preferably 12 to 18 carbon atoms.

Also useful are beta-branched alkyl sulphate surfactants or mixtures of commercial available materials, having a weight average (of the surfactant or the mixture) branching degree of at least 50%.

Mid-chain branched alkyl sulphates or sulfonates are also suitable anionic surfactants for use in the compositions of the invention. Preferred are the $C_5$–$C_{22}$, preferably $C_{10}$–$C_{20}$ mid-chain branched alkyl primary sulphates. When mixtures are used, a suitable average total number of carbon atoms for the alkyl moieties is preferably within the range of from greater than 14.5 to 17.5. Preferred mono-methyl-branched primary alkyl sulphates are selected from the group consisting of the 3-methyl to 13-methyl pentadecanol sulphates, the corresponding hexadecanol sulphates, and mixtures thereof. Dimethyl derivatives or other biodegradable alkyl sulphates having light branching can similarly be used.

Other suitable anionic surfactants for use herein include fatty methyl ester sulphonates and/or alkyl ethyoxy sulphates (AES) and/or alkyl polyalkoxylated carboxylates (AEC). Mixtures of anionic surfactants can be used, for example mixtures of alkylbenzenesulphonates and AES.

The anionic surfactants are typically present in the form of their salts with alkanolamines or alkali metals such as sodium and potassium. Preferably, the anionic surfactants are neutralized with alkanolamines such as Mono Ethanol Amine or Triethanolamine, and are fully soluble in the liquid matrix of the compositions herein.

(a2) Amphoteric and Zwitterionic Surfactants: Suitable amphoteric or zwitterionic detersive surfactants for use in the composition herein include those which are known for use in hair care or other personal care cleansing. Non-limiting examples of suitable zwitterionic or amphoteric surfactants are described in U.S. Pat. No. 5,104,646 (Bolich Jr. et al.), U.S. Pat. No. 5,106,609 (Bolich Jr. et al.).

Amphoteric detersive surfactants suitable for use in the composition are well known in the art, and include those surfactants broadly described as derivatives of aliphatic secondary and tertiary amines in which the aliphatic radical can be straight or branched chain and wherein one of the aliphatic substituents contains from 8 to 18 carbon atoms and one contains an anionic group such as carboxy, sulfonate, sulfate, phosphate, or phosphonate. Suitable amphoteric detersive surfactants for use in the present invention include cocoamphoacetate, cocoamphodiacetate, lauroamphoacetate, lauroamphodiacetate, and mixtures thereof.

Zwitterionic detersive surfactants suitable for use in the compositions are well known in the art, and include those surfactants broadly described as derivatives of aliphatic quaternary ammonium, phosphonium, and sulfonium compounds, in which the aliphatic radicals can be straight or branched chain, and wherein one of the aliphatic substituents contains from 8 to 18 carbon atoms and one contains an anionic group such as carboxy, sulfonate, sulfate, phosphate or phosphonate. Zwitterionics such as betaines are suitable for use in this invention.

Furthermore, amine oxide surfactants having the formula: $R(EO)_x(PO)_y(BO)_zN(O)(CH_2R')_2.qH_2O$ (I) are also suitable for incorporation within the compositions of the present invention. R is a relatively long-chain hydrocarbyl moiety which can be saturated or unsaturated, linear or branched, and can contain from 8 to 20, preferably from 10 to 16 carbon atoms, and is more preferably $C_{12}$–$C_{16}$ primary alkyl. R' is a short-chain moiety preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide.

Non-limiting examples of other anionic, zwitterionic, amphoteric or optional additional surfactants suitable for use in the compositions are described in McCutcheon's, Emulsifiers and Detergents, 1989 Annual, published by M. C. Publishing Co., and in U.S. Pat. Nos. 3,929,678, 2,658,072; 2,438,091; 2,528,378.

(a3) Nonionic Surfactants—The present compositions may also comprise and preferably do comprise this type of detersive surfactant. Essentially any alkoxylated nonionic surfactant, suitably one containing only carbon, hydrogen and oxygen can be included in the present compositions, although amido-functional and other heteroatom-functional types can in general also be used. Ethoxylated, propoxylated, butoxylated or mixed alkoxylated, for example ethoxylated/propoxylated aliphatic or aromatic hydrocarbyl chain nonionic surfactants are preferred. Suitable hydrocarbyl moieties can contain from 6 to 22 carbon atoms and can be linear, branched, cycloaliphatic or aromatic and the nonionic surfactant can be derived from a primary or secondary alcohol.

Preferred alkoxylated surfactants can be selected from the classes of the nonionic condensates of ethoxylated and ethoxylated/propoxylated or propoxylated/ethoxylated linear or lightly branched monohydric aliphatic alcohols, which can be natural or synthetic. Alkylphenyl alkoxylates such as the nonylphenyl ethoxylates can also suitably be used.

Especially suitable as nonionic surfactant or cosurfactant are the condensation products of primary aliphatic alcohols with from 1 to 75 moles of $C_2$–$C_3$ alkylene oxide, more suitably 1 to 15 moles, preferably 1 to 11 moles. Particularly preferred are the condensation products of alcohols having an alkyl group containing from 8 to 20 carbon atoms with from 2 to 9 moles and in particular 3 or 5 moles, of ethylene oxide per mole of alcohol.

Suitable nonionic surfactants containing nitrogen as heteroatom include the polyhydroxy fatty amides having the structural formula $R^1CONR^2Z$ wherein $R^1$ is a $C_5$–$C_{31}$ hydrocarbyl, preferably straight-chain $C_7$–$C_{19}$ alkyl or alkenyl, more preferably straight-chain $C_{11}$–$C_{17}$ alkyl or alkenyl, or mixture thereof; $R^2$ is H, $C_{1-18}$, preferably $C_1$–$C_4$ hydrocarbyl, 2-hydroxethyl, 2-hydroxypropyl, ethoxy, propoxy, or a mixture thereof, preferably $C_1$–$C_4$ alkyl, more preferably methyl; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar such as glucose, a corresponding preferred compound being a $C_{11}$–$C_{17}$ alkyl N-methyl glucamide.

Other nonionic surfactants useful herein include the so-called "capped" nonionics in which one or more —OH moieties are replaced by —OR wherein R is typically lower alkyl such as $C_1$–$C_3$ alkyl; the long-chain alkyl polysaccharides, more particularly the polyglycoside and/or oligosaccharide type, as well as nonionic surfactants derivable by esterifying fatty acids.

(a4) Cationic Nitrogen-Containing Detersive Surfactants—Cationic nitrogen-containing detersive surfactants suitable for use in the compositions of the present invention have at least one quaternized nitrogen and one long-chain hydrocarbyl group. Compounds comprising two, three or even four long-chain hydrocarbyl groups are also included. Examples of such cationic surfactants include alkyltrimethylammonium salts or their hydroxyalkyl substituted analogs, preferably compounds having the formula $R_1R_2R_3R_4N^+X^-$. $R_1$, $R_2$, $R_3$ and $R_4$ are independently selected from $C_1$–$C_{26}$ alkyl, alkenyl, hydroxyalkyl, benzyl, alkylbenzyl, alkenylbenzyl, benzylalkyl, benzylalkenyl and X is an anion. The hydrocarbyl groups $R_1$, $R_2$, $R_3$ and $R_4$ can independently be alkoxylated, preferably ethoxylated or propoxylated, more preferably ethoxylated with groups of the general formula $(C_2H_4O)_xH$ where x has a value from 1 to 15, preferably from 2 to 5. Not more than one of $R_2$, $R_3$ or $R_4$ should be benzyl. The hydrocarbyl groups $R_1$, $R_2$, $R_3$ and $R_4$ can independently comprise one or more, preferably two, ester-([—O—C(O)—]; [—C(O)—O—]) and/or an amido-groups ([O—N(R)—]; [—N(R)—O—]) wherein R is defined as $R_1$ above. The anion X may be selected from halide, methysulfate, acetate and phosphate, preferably from halide and methylsulfate, more preferably from chloride and bromide. The $R_1$, $R_2$, $R_3$ and $R_4$ hydrocarbyl chains can be fully saturated or unsaturated with varying Iodine value, preferably with an Iodine value of from 0 to 140. At least 50% of each long chain alkyl or alkenyl group is predominantly linear, but also branched and/or cyclic groups are included.

For cationic surfactants comprising only one long hydrocarbyl chain, the preferred alkyl chain length for $R_1$ is $C_{12}$–$C_{15}$ and preferred groups for $R_2$, $R_3$ and $R_4$ are methyl and hydroxyethyl.

For cationic surfactants comprising two or three or even four long hydrocarbyl chains, the preferred overall chain length is $C_{18}$, though mixtures of chainlengths having non-zero proportions of lower, e.g., $C_{12}$, $C_{14}$, $C_{16}$ and some higher, e.g., $C_{20}$ chains can be quite desirable.

Preferred ester-containing surfactants have the general formula $$\{(R_5)_2N((CH_2)_nER_6)_2\}^+X^-$$

wherein each $R_5$ group is independently selected from $C_{1,4}$ alkyl, hydroxyalkyl or $C_{2-4}$ alkenyl; and wherein each $R_6$ is independently selected from $C_{8-28}$ alkyl or alkenyl groups; E is an ester moiety i.e., —OC(O)— or —C(O)O—, n is an integer from 0 to 5, and $X^{31}$ is a suitable anion, for example chloride, methosulfate and mixtures thereof.

A second type of preferred ester-containing cationic surfactant can be represented by the formula: $\{(R_5)_3N(CH_2)_n CH(O(O)CR_6)CH_2O(O)CR_6\}^+X^-$ wherein $R_5$, $R_6$, X, and n are defined as above. This latter class can be exemplified by 1,2 bis[hardened tallowoyloxy]-3-trimethylammonium propane chloride.

The cationic surfactants, suitable for use in the compositions of the present invention can be either water-soluble, water-dispersable or water-insoluble.

B, Enzymes and Enzymes Stabilization System—B1, Enzymes

The present compositions comprise as another essential component at least one enzyme. Enzymes can be used at their art-taught levels, for example at levels recommended by suppliers such as Novo and Genencor. Typical levels in the compositions of the present invention of pure enzymes are from 0.0001% to 10%, preferably from 0.0005% to 5.0%, more preferably from 0.001 to 2.5% by weight of the composition. Enzymes suitable for incorporation into the laundry detergent composition of the present invention can be selected from the group consisting of peroxidases, proteases, gluco-amylases, amylases, xylanases, cellulases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, dextranase, transferase, laccase, mannanase, xyloglucanases, derivatives thereof and mixtures thereof, of any suitable origin, such as vegetable, animal, bacterial, fungal and yeast origin.

The following enzymes are preferred for incorporation into the compositions of the present invention:

Proteases like subtilisins from *Bacillus* [e.g. *subtilis, lentus, licheniformis, amyloliquefaciens* (BPN, BPN'), *alcalophilus*,] e.g. Esperase®, Alcalase®, Everlase® and Savinase® (Novozymes), BLAP and variants [Henkel]. Further proteases are described in EP 130 756, WO 91/06 637, WO 95/10 591 and WO 99/20 726. Amylases (α and/or β) are described in WO 94/02 597 and WO 96/23 873. Commercial examples are Purafect Ox Am® [Genencor] and Termamyl®, Natalase®, Ban®, Fungamyl® and Duramyl® [all ex Novozymes]. Cellulases include bacterial or fungal cellulases, e.g. produced by *Humicola insolens*, particularly DSM 1800, e.g. 50 Kda and 43 kD [Carezyme®]. Also suitable cellulases are the EGIII cellulases from *Trichoderma longibrachiatum*. Suitable lipases include those produced by *Pseudomonas* and *Chromobacter* groups. More preferred are e.g. Lipolase®, Lipolase Ultra®, Lipoprime® and Lipex® from Novozymes. Also suitable are cutinases [EC 3.1.1.50] and esterases. Carbohydrases e.g. mannanase (U.S. Pat. No. 6,060,299), pectate lyase (WO 99/27 083) cyclomaltodextringlucanotransferase (WO 96/33 267), xyloglucanase (WO 99/02 663). Bleaching enzymes eventually with enhancers include e.g. peroxidases, laccases, oxygenases, (e.g. catechol 1,2 dioxygenase, lipoxygenase) (WO 95/26 393), (non-heme) haloperoxidases.

It is common practice to modify wild-type enzymes via protein/genetic engineering techniques in order to optimize their performance in the detergent compositions.

B2, Enzyme Stabilization System

The present compositions comprise as another essential component at least one boron-based enzyme stabilization system. Boron-based enzyme stabilization systems are typically used at levels from 0.01% to 10%, preferably from 0.05% to 6.0%, and more preferably from 0.1% to 3.0% by weight of the composition, expressed as boric acid. The enzyme stabilization system can contain one or more than one component. Typically, the enzyme stabilization system of the present invention contains boric acid or salts thereof, preferably capable of forming boric acid in the composition. Boric acid is preferred, although other compounds such as boric oxide, borax and other alkali metal borates (e.g., sodium ortho-, meta-, pyroborate, a sodium pentaborate) are suitable. Substituted boric acids (e.g., phenylboronic acid, butane boronic acid and p-bromo phenyl boronic acid) can also be used in place of boric acid.

C, Fabric Care Ingredient—

The present compositions comprise as another essential component at least one fabric care ingredient, which is not a fabric cleaning ingredient. Suitable concentrations of fabric care ingredients are from 0.01% to 30%, preferably from 0.1% to 10%, and more preferably from 0.5% to 5.0% by weight of the composition.

In general, any fabric care ingredient known in the art of detergent composition may be used. However, certain fabric care ingredients are preferred, such as fabric care ingredients selected from the group consisting of clays, silicon-free amine compounds, silicon-free quaternary ammonium based compounds, nitrogen-free silicone polymers, amino silicone polymers, anionic silicone polymers, cationic silicone polymers, polyolefins, and mixtures thereof.

(c1) Clays—Clays can be present as fabric care ingredient in the compositions of the present invention. In general, any claim can be incorporated into the compositions of the present invention. Typically, the clay is selected from the group consisting of: allophane clays; chlorite clays, preferred chlorite clays are amesite clays, baileychlore clays, chamosite clays, clinochlore clays, cookeite clays, corundophite clays, daphnite clays, delessite clays, gonyerite clays, nimite clays, odinite clays, orthochamosite clays, pannantite clays, penninite clays, rhipidolite clays, sudoite clays and thuringite clays; illite clays; inter-stratified clays; iron oxyhydroxide clays, preferred iron oxyhydoxide clays are hematite clays, goethite clays, lepidocrite clays and ferrihydrite clays; kaolin clays, preferred kaolin clays are kaolinite clays, halloysite clays, dickite clays, nacrite clays and hisingerite clays; smectite clays; vermiculite clays; and mixtures thereof.

Preferably, the clay is a smectite clay. Preferred smectite clays are beidellite clays, hectorite clays, laponite clays, montmorillonite clays, nontonite clays, saponite clays and mixtures thereof. Preferably, the smectite clay is a dioctahedral smectite clay. Preferred dioctahedral smectite clays are montmorillonite clays. The montmorillonite clay may be a low-charged montmorillonite clay (also known as sodium montmorillonite clay or Wyoming-type montmorillonite clay). The montmorillonite clay may be a high-charged montmorillonite clay (also known as calcium montmorillonite clay or Cheto-type montmorillonite clay).

The clay may be a light coloured crystalline clay mineral, preferably having a reflectance of at least 60, more preferably at least 70, or at least 80 at a wavelength of 460 nm. Preferred light coloured crystalline clay minerals are china clays, halloysite clays, dioctahedral clays such as kaolinite, trioctahedral clays such as antigorite and amesite, smectite and hormite clays such as bentonite (montmorillonite), beidilite, nontronite, hectorite, attapulgite, pimelite, mica, muscovite and vermiculite clays, as well as pyrophyllite/talc, willemseite and minnesotaite clays. Preferred light coloured crystalline clay minerals are described in GB2357523A and WO01/44425.

The clay, when present in the composition, is preferably in the form of a dispersion, typically having a volume average particle size of from 1 micrometer to 5,000 micrometers, preferably from 1 micrometer to 50 micrometers.

The clays herein are available under commercial names such as "fooler clay" (clay found in a relatively thin vein above the main bentonite or monmorillonite veins in the Black Hills) and various tradenames such as Thixogel #1 (also, "Thixo-Jell") and Gelwhite GP from Georgia Kaolin Co. Elizabeth, N.J.; Volclay BC and Volclay #325, from American Colloid Co., Skokie, Ill.; Black Hills Bentonite BH 450, from International Minerals and Chemicals; and Veegum Pro and Veegum F, from R. T. Vanderbuilt. It is to be recognized that such smectite-type minerals obtained under the foregoing commercial and tradenames can comprise mixtures of the various discrete mineral entitites. Such mixtures of the smecite minerals are suitable for use herein. Examples of hectorite clays suitable for the present compositions include Bentone EW and Macaliod, from NL Chemicals, NJ, US, and hectorites from Industrial Mineral Ventures.

Highly preferred are organophilic clays as available from Rheox/Elementis, such as Bentone SD-1 and Bentone SD-3, which are registered trademarks of Rheox/Elementis.

(c2) Silicon-Free Quaternary Ammonium Based Compounds—In general, any silicone-free quaternary ammonium based compound can be incorporated into the compositions of the present invention. Preferred quaternary ammonium fabric softening active compounds having the formula

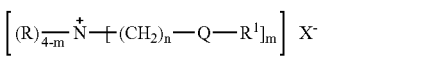

(1)

or the formula:

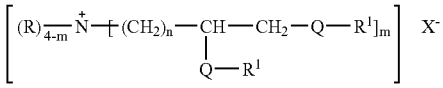

(2)

wherein Q is a carbonyl unit having the formula:

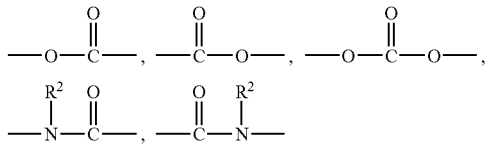

each R unit is independently hydrogen, $C_1$–$C_6$ alkyl, $C_1$–$C_6$ hydroxyalkyl, and mixtures thereof, preferably methyl or hydroxy alkyl; each $R^1$ unit is independently linear or branched $C_{11}$–$C_{22}$ alkyl, linear or branched $C_{11}$–$C_{22}$ alkenyl, and mixtures thereof, $R^2$ is hydrogen, $C_1$–$C_4$ alkyl, $C_1$–$C_4$ hydroxyalkyl, and mixtures thereof; X is an anion which is compatible with fabric softener actives and adjunct ingredients; the index m is from 1 to 4, preferably 2; the index n is from 1 to 4, preferably 2.

An example of a preferred fabric softener active is a mixture of quaternized amines having the formula:

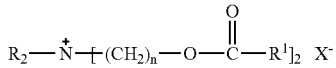

wherein R is preferably methyl; $R^1$ is a linear or branched alkyl or alkenyl chain comprising at least 11 atoms, preferably at least 15 atoms. In the above fabric softener example, the unit $—O_2CR^1$ represents a fatty acyl unit which is typically derived from a triglyceride source. The triglyceride source is preferably derived from tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures of these oils.

The counterion, $X^{(-)}$ above, can be any softener-compatible anion, preferably the anion of a strong acid, for example, chloride, bromide, methylsulfate, ethylsulfate, sulfate, nitrate and the like, more preferably chloride or methyl sulfate. The anion can also, but less preferably, carry a double charge in which case $X^{(-)}$ represents half a group.

TABLE I

| Fabric Softener Actives |
|---|
| N,N-di(tallowyl-oxy-ethyl)-N,N-dimethyl ammonium chloride |
| N,N-di(canolyl-oxy-ethyl)-N,N-dimethyl ammonium chloride |
| N,N-di(tallowyl-oxy-ethyl)-N-methyl, N-(2-hydroxyethyl) ammonium chloride |
| N,N-di(canolyl-oxy-ethyl)-N-methyl, N-(2-hydroxyethyl) ammonium chloride |
| N,N-di(2-tallowyloxy-2-oxo-ethyl)-N,N-dimethyl ammonium chloride |
| N,N-di(2-canolyloxy-2-oxo-ethyl)-N,N-dimethyl ammonium chloride |
| N,N-di(2-tallowyloxyethylcarbonyloxyethyl)-N,N-dimethyl ammonium chloride |
| N,N-di(2-canolyloxyethylcarbonyloxyethyl)-N,N-dimethyl ammonium chloride |
| N-(2-tallowoyloxy-2-ethyl)-N-(2-tallowyloxy-2-oxo-ethyl)-N,N-dimethylammonium chloride |
| N-(2-canolyloxy-2-ethyl)-N-(2-canolyloxy-2-oxo-ethyl)-N,N-dimethyl ammonium chloride |
| N,N,N-tri(tallowyl-oxy-ethyl)-N-methyl ammonium chloride |
| N,N,N-tricanolyl-oxy-ethyl)-N-methyl ammonium chloride |
| N-(2-tallowyloxy-2-oxoethyl)-N-(tallowyl)N,N-dimethyl ammonium chloride |
| N-(2-canolyloxy-2-oxoethyl)-N-(canolyl)-N,N-dimethyl ammonium chloride |
| 1,2-ditallowyloxy-3-N,N,N-trimethylammoniopropane chloride, and |
| 1,2-dicanolyloxy-3-N,N,N-trimethylammoniopropane chloride. |
| mixtures of the above actives. |

Other examples of quaternary ammonium softening compounds are methylbis(tallowamidoethyl)(2-hydroxyethyl) ammonium methylsulfate and methylbis(hydrogenatedtallowamidoethyl)(2-hydroxyethyl) ammonium methylsulfate which are available from Degussa (Goldschmidt) Chemical Company under the trade names Varisoft® 222 and Varisoft® 110, respectively. Particularly preferred are N,N-di (canolyl-oxy-ethyl)-N,N-dimethyl ammonium chloride and N,N-di(canolyl-oxy-ethyl)-N-methyl, N-(2-hydroxyethyl) ammonium methyl sulfate.

As described herein before, R units are preferably methyl, however, suitable fabric softener actives are described by replacing the term "methyl" in the above examples in Table I with the units: ethyl, ethoxy, propyl, propoxy, isopropyl, butyl, isobutyl and t-butyl.

Other DEQA cationic scavenging agents described herein that can be used in the preparation of the composition herein and having desirable levels of unsaturation, and their syntheses, are described in WO 98/03 619 with good freeze/thaw recovery.

Mixtures of actives of formula (1) and (2) may also be prepared.

(c3) Silicon-Free amine Compounds—The amine equivalents of softeners described in (c2) are also suitable for incorporation as fabric care ingredient in the liquid laundry detergent compositions of the present invention.

(c4) Nitrogen-Free Silicone Polymers—Suitable levels of this component are in the range from 0.0% to 90%, preferably from 0.01% to 50%, more preferably from 0.1% to 10%, and most preferably from 0.5% to 5.0%, by weight of the composition.

The nitrogen-free silicone polymer selected for use in the compositions of the present invention includes nonionic, zwitterionic and amphoteric nitrogen-free silicone polymers.

Preferably, the nitrogen-free silicone polymer is selected from nonionic nitrogen-free silicone polymers having the formulae (I) to (III):

(I)

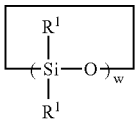

(II)

$$R^2—(R^1)_2SiO—[(R^1)_2SiO]_a—[(R^1)(R^2)SiO]_b—Si(R^1)_2—R^2$$

(III)

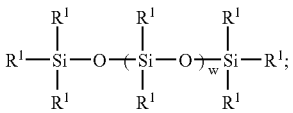

and mixtures thereof, wherein each $R^1$ is independently selected from the group consisting of linear, branched or cyclic alkyl groups having from 1 to 20 carbon atoms; linear, branched or cyclic alkenyl groups having from 2 to 20 carbon atoms; aryl groups having from 6 to 20 carbon atoms; alkylaryl groups having from 7 to 20 carbon atoms; arylalkyl and arylalkenyl groups having from 7 to 20 carbon atoms and mixtures thereof; each $R^2$ is independently selected from the group consisting of linear, branched or cyclic alkyl groups having from 1 to 20 carbon atoms; linear, branched or cyclic alkenyl groups having from 2 to 20 carbon atoms; aryl groups having from 6 to 20 carbon atoms; alkylaryl groups having from 7 to 20 carbon atoms; arylalkyl; arylalkenyl groups having from 7 to 20 carbon atoms and from a poly(ethyleneoxide/propyleneoxide) copolymer group having the general formula (IV):

$$—(CH_2)_nO(C_2H_4O)_c(C_3H_6O)_dR^3 \quad (IV)$$

with at least one $R^2$ being a poly(ethyleneoxy/propyleneoxy) copolymer group, and each $R^3$ is independently selected from the group consisting of hydrogen, an alkyl having 1 to 4 carbon atoms, and an acetyl group, wherein the index w has the value as such that the viscosity of the nitrogen-free silicone polymer of formulae (I) and (III) is between $2\cdot10^{-6}$ $m^2/s$ (2 centistokes at 20° C.) and 50 $m^2/s$ (50,000,000 centistokes at 20° C.); wherein a is from 1 to 50; b is from 1 to 50; n is 1 to 50; total c (for all polyalkyleneoxy side groups) has a value of from 1 to 100; total d is from 0 to 14; total c+d has a value of from 5 to 150.

More preferably, the nitrogen-free silicone polymer is selected from linear nonionic nitrogen-free silicone polymers having the formulae (II) to (III) as above, wherein $R^1$ is selected from the group consisting of methyl, phenyl, and phenylalkyl; wherein $R^2$ is selected from the group consisting of methyl, phenyl, phenylalkyl and from the group having the general formula (IV), defined as above; wherein $R^3$ is defined as above and wherein the index w has the value as such that the viscosity of the nitrogen-free silicone polymer of formula (III) is between 0.01 $m^2/s$ (10,000 centistokes at 20° C.) and 0.8 $m^2/s$ (800,000 centistokes at 20° C.); a is from 1 to 30, b is from 1 to 30, n is from 3 to 5, total c is from 6 to 100, total d is from 0 to 3, and total c+d is from 7 to 100.

Most preferably, the nitrogen-free silicone polymer is selected from linear nonionic nitrogen-free silicone polymers having the formula (III) as above, wherein $R^1$ is methyl and wherein the index w has the value as such that the viscosity of the nitrogen-free silicone polymer of formula (III) is between 0.06 $m^2/s$ (60,000 centistokes at 20° C.) and 0.7 $m^2/s$ (700,000 centistokes at 20° C.) and more preferably between 0.1 $m^2/s$ (100,000 centistokes at 20° C.) and 0.48 $m^2/s$ (480,000 centistokes at 20° C.), and mixtures thereof.

Non-limiting examples of nitrogen-free silicone polymers of fomula (II) are the Silwet® compounds which are available from OSI Specialties Inc., a Division of Witco, Danbury, Conn., USA. Non-limiting examples of nitrogen-free silicone polymers of fomula (I) and (III) are the Silicone 200 fluid series from Dow Corning.

(c5) Amino Silicone Polymers—Herein "aminosilicone" means any amine functionalized silicone; i.e., a silicone containing at least one primary amine, secondary amine, or tertiary amine. Quaternized amino-functionalized silicones, i.e. quaternary ammonium silicones, are also enclosed in the definition of functionalised silicones for the purpose of the present invention. Preferred aminosilicones have a mole % nitrogen content in the range from 0.01 mole % to 10 mole %, more preferably from 0.05 mole % to 1.0 mole %, and most preferably from 0.3 mole % to 0.5 mole %. If present, the amino silicone polymer is typically present at levels in the range of from 0.001% to 50%, preferably at least from 0.01% to 30%, more preferably from 0.1% to 10%, and most preferably from 0.2% to 5.0%, by weight of the composition.

Typically, the aminosilicone has a viscosity of from 0.001 $m^2/s$ (1,000 centistokes at 20° C.) to 0.05 $m^2/s$ (50,000 centistokes at 20° C.), more preferably 0.002 $m^2/s$ (2,000 centistokes at 20° C.) to 0.03 $m^2/s$ (30,000 centistokes at 20° C.), more preferably from 0.004 $m^2/s$ (4,000 centistokes at 20° C.) to 0.02 $m^2/s$ (20,000 centistokes at 20° C.).

Examples of preferred aminosilicones for use in the compositions of the present invention include but are not limited to, those which conform to the general formula (V):

$$(R_1)_aG_{3-a}\text{-Si}—(—OSiG_2)_n\text{-}(—OSiG_b(R_1)_{2-b})_m—O—SiG_{3-a}(R_1)_a \quad (V)$$

wherein G is hydrogen, phenyl, hydroxy, or $C_1$–$C_8$ alkyl, preferably methyl; a is 0 or an integer having a value from 1 to 3, preferably 1; b is 0, 1 or 2, preferably 1; n is a number from 0 to 1,999, preferably from 49 to 500; m is an integer from 1 to 2,000, preferably from 1 to 10; the sum of n and m is a number from 1 to 2,000, preferably from 50 to 500; $R_1$ is a monovalent radical conforming to the general formula $C_qH_{2q}L$, wherein q is an integer having a value from 2 to 8 and L is selected from the following groups: $—N(R_2)CH_2—CH_2—N(R_2)_2$; $—N(R_2)_2$; wherein $R_2$ is hydrogen, phenyl, benzyl, or a saturated hydrocarbon radical, preferably an alkyl radical from $C_1$ to $C_{20}$.

A preferred aminosilicone corresponding to formula (V) is the shown below in formula (VI):

(VI)

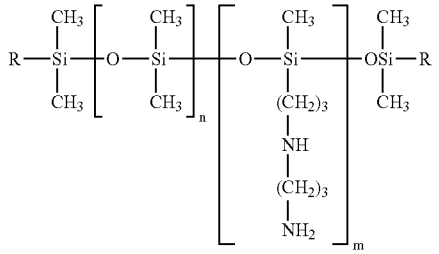

wherein R is independently selected from C1 to C4 alkyl, alkoxy, hydroxyalkyl and mixtures thereof, preferably from methyl and methoxy. When both R groups are methyl, the above polymer is known as "trimethylsilylamodimethicone".

Most preferred amino silicones are those commercially available from Wacker, sold under the tradename of Wacker Belsil® ADM 1100 and Wacker Finish® WR 1100, and from General Electric sold as General Electric® SF 1923, and Waro® 2166.

(c6) Anionic Silicone Polymers—In general, any anionic silicone polymer can be incorporated into the compositions of the present invention. Preferred anionic silicone polymers are selected from the group consisting of silicones comprising at least one carboxylate, sulfate, sulfonate, phosphate or phosphonate group and derivatives thereof and mixtures thereof. If present, the anionic silicone-containing polymer is typically present at levels in the range of from 0.001% to 50%, preferably at least from 0.01% to 30%, more preferably from 0.1% to 10%, and most preferably from 0.2% to 5% by weight of the composition. Most preferred anionic silicone-containing polymers are those commercially available from BASF, sold under the tradename of Densodrin® OF and Densodrin® SI; from Osi/Crompton, sold under the tradename of FZ-3703®; from Toray/Dow Corning Silicones, sold under the tradename of BY 16-750® and BY 16-880®; from Noveon/BF Goodrich, sold under the tradename of Ultrasil® CA-1; from Shin Etsu, sold under the tradename of X22-3701E® and from Wacker, sold under the tradename of M-642®.

(c7) Cationic Silicone Polymer—In general, any cationic silicone polymer can be incorporated into the compositions of the present invention. Preferred cationically charged functionalized silicones are disclosed in the Applicant's co-pending applications WO 02/018528 and EP 02 447 167.4.

Synthesis Example—When not otherwise known or available in commerce, the cationic silicone polymers herein can be prepared by conventional techniques as disclosed in WO 02/18 528.

(c8) Polyolefins—The liquid detergent compositions of the present invention can also include a dispersible polyolefin. Preferably, the polyolefin is a polyethylene, polypropylene or mixtures thereof. The polyolefin may be at least partially modified to contain various functional groups, such as carboxyl, alkylamide, sulfonic acid or amide groups. More preferably, the polyolefin employed in the compositions of the present invention is at least partially carboxyl modified or, in other words, oxidized. In particular, oxidized or carboxyl modified polyethylene is preferred in the compositions of the present invention.

For ease of formulation, the polyolefin is preferably introduced as a suspension or an emulsion of polyolefin dispersed by use of an emulsifing agent. The polyolefin suspension or emulsion preferably has from 1% to 50%, more preferably from 10% to 35% by weight, and most preferably from 15% to 30% by weight of polyolefin in the emulsion. The polyolefin preferably has a molecular weight of from 1,000 to 15,000 and more preferably from 4,000 to 10,000.

When an emulsion is employed, the emulsifier may be any suitable emulsification or suspending agent. Preferably, the emulsifier is a cationic, nonionic, zwitterionic or anionic surfactant or mixtures thereof. Most any suitable cationic, nonionic or anionic surfactant may be employed as the emulsifier of the present invention. Preferred emulsifiers for use in the compositions of the present invention are either nonionic surfactants such as ethoxylated alcohols or cationic surfactants such as the fatty amine surfactants and in particular the ethoxlated fatty amine surfactants. In particular, the cationic surfactants are preferred as emulsifiers in the compositions of the present invention. The polyolefin is dispersed with the emulsifier or suspending agent in a ratio of emulsifier to polyolefin of from 1:10 to 3:1. Preferably, the emulsion includes from 0.1% to 50%, more preferably from 1% to 20% and most preferably from 2.5% to 10% by weight of emulsifier in the polyolefin emulsion. Polyethylene emulsions and suspensions suitable for use in the present invention are available from Michelman Inc. U.S.A., and under the tradename VELUSTROL from HOECHST Aktiengesellschaft of Frankfurt am Main, Germany. In particular, the polyethylene emulsions sold under the tradename VELUSTROL PKS, VELUSTROL KPA, or VELUSTROL P-40 may be employed in the compositions of the present invention.

The compositions of the present invention may contain from 0.1% to 50% by weight of the polyolefin. More preferably, the compositions include from 1% to 35% by weight and most preferably from 1% to 30% by weight of the polyolefin. When the polyolefin is added to the compositions of the present invention as an emulsion or suspension, the emulsion or suspension is added at sufficient enough quantities to provide the above noted levels of dispersible polyolefin in the compositions.

(c9) Mixtures of any of (c1) to (c8) are also disclosed.

D, Modified Cationic Deposition Aid—The compositions of the present invention further comprise as essential component at least one modified cationic deposition aid. The deposition aid is for enhancing the deposition rate and extend of the fabric care ingredient present. The deposition aid is modified in such a way that it does not exhibit interaction with the enzyme stabilizing system comprising boron-based stabilizers such as boric acid and/or salts thereof. The deposition aids suitable for incorporation into the compositions of the present invention are those which contain prior to modification, at least one pair of 1,2-cis-dihydroxy groups referred to as "cis-hydroxy groups". After modification, at least one hydroxy group per pair of cis-hydroxy groups is at least partly substituted so that the enzyme stabilizing system does not exhibit interaction with the cationic deposition aid. Typical levels of this component are in the range from 0.001% to 10%, preferably from 0.05% to 5.0%, more preferably from 0.1% to 2.5% by weight of the composition.

In a preferred embodiment of the present invention, the cationic deposition aid is a cationically derivatized natural or synthetic polysaccharide containing cis-hydroxy groups, wherein on average at least one hydrogen atom per pair of cis-hydroxy groups is at least partly or completely substituted with a cationic substituent or with a nonionic substituent.

In an even more preferred embodiment of the present invention, the cationic deposition aid is based on a natural or synthetic polysaccharide, wherein said polysaccharide is derived from mannoses, or riboses, preferably from galactomannoses.

The cationic deposition aids of the present invention are modified in such a way that at least one hydrogen atom per pair of cis-hydroxy groups of the polysaccharide is at least partly substituted, preferably substituted with a cationic or nonionic substitutent. Suitable cationic substituents for these cis-hydroxy groups have the formulas (1) or (2) as below:

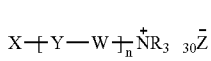

(1)

wherein X and W are the same or different and are independently selected from: substituted or unsubstituted alkylene, substituted or unsubstituted alkenylene, substituted or unsubstituted alkynylene, substituted or unsubstituted arylene, or combinations thereof; preferably X and W are the same or different and are independently selected from: substituted or unsubstituted alkylene, substituted or unsubstituted alkenylene, or combinations thereof; more preferably X and W are the same or different and are independently selected from: substituted or unsubstituted $C_1$–$C_{10}$ alkylene, substituted or unsubstituted $C_2$–$C_{10}$ alkenylene, or combinations thereof; most preferably X and W are the same or different and are independently selected from: substituted or unsubstituted $C_1$–$C_3$ alkylene, substituted or unsubstituted $C_2$–$C_4$ alkenylene, or combinations thereof;

Y=O, S, Se, or Te; preferably O, or S; more preferably O;

n=0 to 100, preferably n=1 to 20, more preferably n=3 to 8;

wherein all three R groups are the same or different and are independently selected from: substituted or unsubstituted alkyl, substituted or unsubstituted alkenyl, substituted or unsubstituted alkynyl, substituted or unsubstituted aryl, substituted or unsubstituted hydroxyalkyl, substituted or unsubstituted alkyloxyalkyl, substituted or unsubstituted alkyloxyhydroxyalkyl, substituted or unsubstituted amine, acetate or combinations thereof; preferably all three R groups are the same or different and are independently selected from: substituted or unsubstituted alkyl, substituted or unsubstituted alkenyl, substituted or unsubstituted aryl, substituted or unsubstituted hydroxyalkyl, substituted or unsubstituted alkyloxyalkyl, substituted or unsubstituted alkyloxyhydroxyalkyl, or combinations thereof; more preferably all three R groups are the same or different and are independently selected from: substituted or unsubstituted alkyl, substituted or unsubstituted hydroxyalkyl, substituted or unsubstituted alkyloxyalkyl, substituted or unsubstituted alkyloxyhydroxyalkyl, or combinations thereof; most preferably all three R groups are the same or different and are independently selected from: substituted or unsubstituted $C_1$–$C_3$ alkyl, substituted or unsubstituted $C_1$–$C_3$ hydroxyalkyl, substituted or unsubstituted $C_2$–$C_8$ alkyloxyalkyl, substituted or unsubstituted $C_2$–$C_8$ alkyloxyhydroxyalkyl, or combinations thereof; and Z=F, Cl, Br, I, alkyl sulfate, alkyl carboxylate, or combinations thereof; preferably Cl, Br, $C_1$–$C_4$ alkyl sulfate, or combinations thereof; more preferably Cl, methyl sulfate, acetate, or combinations thereof; or

X-T (2)

wherein X is defined as above and T is a cationically charged cyclic substituent, comprising at least one quaternized nitrogen atom.

Examples of substituent T include: substituted and unsubstituted quaternized imidazole, substituted and unsubstituted quaternized piperazine, substituted and unsubstituted quaternized pyrrole, substituted and unsubstituted quaternized pyrroline, substituted and unsubstituted quaternized pyrrolidine, substituted and unsubstituted quaternized pyridine, substituted and unsubstituted quaternized pyrimidine, substituted and unsubstituted quaternized dihydropyrrole, substituted and unsubstituted quaternized thiazole, substituted and unsubstituted quaternized thiadiazine, substituted and unsubstituted quaternized pyrazole, substituted and unsubstituted quaternized imidazole, substituted and unsubstituted quaternized oxazole, substituted and unsubstituted quaternized isoxazole, substituted and unsubstituted quaternized isothiazole, substituted and unsubstituted quaternized triazole, substituted and unsubstituted quaternized tetrazole, substituted and unsubstituted quaternized piperidine, substituted and unsubstituted quaternized pyridazine (1,2-; 1,3-, 1,4-isomer), substituted and unsubstituted quaternized triazine, and mixtures thereof; preferably T is selected from: substituted and unsubstituted quaternized imidazole, substituted and unsubstituted quaternized piperazine, substituted and unsubstituted quaternized pyrrolidine, substituted and unsubstituted quaternized pyridine, substituted and unsubstituted quaternized dihydropyrrole, substituted and unsubstituted quaternized piperidine, and mixtures thereof.

Suitable nonionic substituents for the cis-hydroxy hydrogen(s) have the formula:

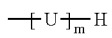

wherein U is selected from: substituted or unsubstituted alkylene, substituted or unsubstituted alkyleneoxy, substituted or unsubstituted alkenylene, substituted or unsubstituted alkynylene, substituted or unsubstituted arylene, substituted or unsubstituted aryleneoxy, or combinations thereof; preferably U is selected from: substituted or unsubstituted alkylene, substituted or unsubstituted alkyleneoxy, or combinations thereof; more preferably U is selected from: substituted or unsubstituted $C_1$–$C_4$ alkylene, substituted or unsubstituted $C_1$–$C_4$ alkyleneoxy; and m=1 to 100, preferably m=1 to 20, and more preferably m=1 to 8.

When referring to the term "unsubstituted" in the above definitions, it is meant that the hydrocarbon group only comprises carbon and hydrogen atoms. When referring to the term "substituted", it is meant that any hydrogen atom of the hydrocarbon group may optionally be substituted, or interrupted, or any carbon chain in the hydrocarbon group may be interrupted with heteroatoms, and/or with heteroatom-containing groups. Heteroatoms are for example halogens, e.g., chlorine, bromine, iodine. Hetero atom-containing groups are for example hydroxy groups, sulfate groups, alkylsulfate groups, sulphonates, alkyl sulphonates, ethers, esters, carbonyl groups, amido groups to name just a few.

The degree of substitution of the cationically substituted hydrogen atom(s) of the cis-hydroxy group(s) in the deposition aid is on average from 0.01 to 1.0, preferably from 0.05 to 0.4, and more preferably from 0.1 to 0.2. The degree of molar substitution of the nonionically substituted hydrogen atom(s) of the cis-hydroxy group(s) in the deposition aid is on average from 0.1 to 5.0, preferably from 0.15 to 2.5, and more preferably from 0.2 to 2.0.

The cationic deposition aid of the present invention is typically a hydroxyalkyl guar hydroxyalkyl trimonium salt, a derivative thereof, or mixtures thereof. Preferably, the cationic deposition aid is a hydroxypropyl guar hydroxypropyl trimonium salt, a derivative thereof, and mixtures thereof.

The charge density of the cationic deposition aid is typically in the range of from 0.1 to 5.0 meq/g, preferably of from 0.15 to 3.0 meq/g, and more preferably of from 0.2 to 2.0 meq/g at the pH of intended use of the composition, which pH will generally range from pH 3 to pH 12, preferably between pH 7 and pH 11.

The molecular weight of the cationic deposition aid typically ranges from 5,000 to 10,000,000 g/mol, preferably from 200,000 to 5,000,000 g/mol, more preferably from 800,000 to 2,000,000 g/mol. Cationic polysccharide-based deposition aids which have been modified at the cis-hydroxy groups can be prepared in the manner as described in U.S. Pat. No. 5,756,720 and/or as exemplified herein after.

Any anionic counterions can be used in association with the modified cationic deposition aids so long as the counterions are physically and chemically compatible with the essential components of the composition or do not otherwise unduly impair product performance, stability or aesthetics. Non-limiting examples of such counterions include halides (e.g., chloride, fluoride, bromide, iodide), sulfate and methylsulfate.

A particular suitable type of modified cationic polysaccharide polymer that can be used is a cationic guar gum derivative, such as the cationic polygalactomannan gum derivatives, which are commercially available from Rhodia in their JAGUAR tradename series. An example of a suitable material is available under the tradename of JAGUAR C-162 and JAGUAR C-2000 which are both hydroxypropyl-substituted materials. In JAGUAR C-162 the cationic charge density is 0.4 meq/g and the degree of hydroxypropyl substitution is 0.6. In JAGUAR C-2000 the cationic charge density is 1.0 meq/g and the degree of hydroxypropyl substitution is 0.6.

K, Laundry Adjunct Materials—

(a) Liquid Carrier—The compositions of the present invention may optionally comprise one or more liquid carriers. The liquid carrier can be aqueous or non-aqueous; and can include water alone or organic solvents alone and/or mixtures thereof. Preferred organic solvents include monohydric alcohols, dihydric alcohols, polyhydric alcohols, glycerol, glycols, polyalkylene glycols such as polyethylene glycol, and mixtures thereof. Suitable monohydric alcohols especially include $C_1$–$C_4$ alcohols, such as ethanol, propanol, isopropanol and butanol. Preferred is 1,2-propanediol. Highly preferred on the organic solvent side are mixtures of solvents, especially mixtures of lower aliphatic alcohols such as ethanol, propanol, butanol, isopropanol, and/or diols such as 1,2-propanediol or 1,3-propanediol. The liquid carrier is typically present at levels in the range of from 1% to 95%, preferably at least from 5% to 70%, more preferably from 10% to 50%, and most preferably from 15% to 30% by weight of the composition.

(b) Builder—The compositions of the present invention may optionally comprise a builder, at levels of from 0.0% to 80% by weight, preferably from 5% to 70% by weight, more preferably from 20% to 60% by weight of the composition.

In general any known detergent builder is useful herein, including inorganic types such as zeolites, layer silicates, fatty acids and phosphates such as the alkali metal polyphosphates, and organic types including especially the alkali metal salts of citrate, 2,2-oxydisuccinate, carboxymethyloxysuccinate, nitrilotriacetate and the like. Phosphate-free, water-soluble organic builders which have relatively low molecular weight, e.g., below 1,000, are highly preferred for use herein. Other suitable builders include sodium carbonate and sodium silicates having varying ratios of $SiO_2$:$Na_2O$ content, e.g., 1:1 to 3:1 with 2:1 ratio being typical.

Preferred are in particular $C_{12}$–$C_{18}$ saturated and/or unsaturated, linear and/or branched, fatty acids, but preferably mixtures of such fatty acids. Highly preferred have been found mixtures of saturated and unsaturated fatty acids, for example preferred is a mixture of rape seed-derived fatty acid and $C_{16}$–$C_{18}$ topped whole cut fatty acids, or a mixture of rape seed-derived fatty acid and a tallow alcohol derived fatty acid, palmitic, oleic, fatty alkylsuccinic acids, and mixtures thereof. Further preferred are branched fatty acids of synthetic or natural origin, especially biodegradable branched types.

Mixtures of any of these fatty acid builders can be advantageous to further promote solubility. It is known that lower chain length fatty acids promote solubility but this needs to be balanced with the knowledge that they are often malodorous, e.g., at chain lengths of C9 and below.

While the term "fatty acid builder" is in common use, it should be understood and appreciated that as formulated in the present detergents, the fatty acid is in at least partially neutralized to neutralized form, the counter-ions can typically be alkanolamines, sodium, potassium, alkanolammonium or mixtures thereof. Preferably, the fatty acids are neutralized with alkanolamines such as Mono Ethanol Amine, and are fully soluble in the liquid phase.

Fatty acids are preferred builders in the compositions of the present invention. It has been found that the presence of fatty acid builders contribute to the formation of a coacervate. The presence of fatty acids builder in the compositions of the present invention is therefore highly preferred (c) Suds Suppressor—The compositions of the present invention may optionally comprise and preferably do comprise a suds suppressor. Suitable suds suppressors for use herein may comprise essentially any known antifoam compound or mixture, typically at a level less than 10%, preferably 0.001% to 10%, more preferably from 0.01% to 8%, most preferably from 0.05% to 5%, by weight of the composition. Suitable suds suppressors can include low solubility components such as highly crystalline waxes and/or hydrogenated fatty acids, silicones, silicone/silica mixtures, or more sophisticated compounded suds suppressor combinations, for example those commercially available from companies such as Dow Corning. Compounded silicones are suitably used at levels of 0.005% to 0.5% by weight. More soluble antifoams include for example the lower 2-alkyl alkanols such as 2-methyl-butanol.

(d) Stabilizer—The compositions of the present invention may optionally comprise and preferably do comprise a stabilizer. Suitable levels of this component are in the range from 0.0% to 20%, preferably from 0.1% to 10%, and even more preferably from 0.1% to 3% by weight of the composition. The stabilizer serves to stabilize certain components of the compositions herein, like the fabric care ingredients and thus preventing them from coagulating and/or creaming.

Stabilizers suitable for use herein can be selected from thickening stabilizers. These include gums and other similar polysaccharides, for example gellan gum, carrageenan gum, and other known types of thickeners and rheological additives other than highly polyanionic types; thus conventional clays are not included.

More preferably the stabilizer is a crystalline, hydroxyl-containing stabilizing agent, more preferably still, a trihydroxystearin, hydrogenated oil or a derivative thereof.

Without intending to be limited by theory, the crystalline, hydroxyl-containing stabilizing agent is a nonlimiting example of a "thread-like structuring system". "Thread-like Structuring System" as used herein means a system comprising one or more agents that are capable of providing a chemical network that reduces the tendency of materials with which they are combined to coalesce and/or phase split. Examples of the one or more agents include crystalline, hydroxyl-containing stabilizing agents and/or hydrogenated jojoba. Surfactants are not included within the definition of the thread-like structuring system. Without wishing to be bound by theory, it is believed that the thread-like structuring system forms a fibrous or entangled threadlike network in-situ on cooling of the matrix. The thread-like structuring system has an average aspect ratio of from 1.5:1, preferably from at least 10:1, to 200:1.

The thread-like structuring system can be made to have a viscosity of 0.002 $m^2/s$ (2,000 centistokes at 20° C.) or less at an intermediate shear range (5 $s^{-1}$ to 50 $s^{-1}$) which allows for the pouring of the detergent out of a standard bottle, while the low shear viscosity of the product at 0.1 $s^{-1}$ can be at least 0.002 $m^2/s$ (2,000 centistokes at 20° C.) but more preferably greater than 0.02 $m^2/s$ (20,000 centistokes at 20° C.). A process for the preparation of a thread-like structuring system is disclosed in WO 02/18528.

(e) Fabric Substantive Perfume—The compositions of the present invention can optionally and preferably do comprise one or more perfumes to provide a "scent signal" in the form of a pleasant odor which provides a freshness impression to the fabrics. The fabric substantive perfume ingredients are suitably at levels in the range from 0.0001% to 10% by weight of the composition and are characterized by their boiling points (B.P.). The fabric substantive perfume ingredients have a B.P, measured at the normal, standard pressure of 760 mm Hg, of 240° C. or higher, and preferably of 250° C. or higher. Preferably the fabric substantive perfume ingredients have a ClogP of greater than 3, more preferably from 3 to 6.

The preferred compositions used in the present invention contain at least 2, preferably at least 3, more preferably at least 4, even more preferably at least 5, even more preferably at least 6, and even more preferably at least 7 different fabric substantive perfume ingredients. Most common perfume ingredients which are derived from natural sources are composed of a multitude of components. When each such material is used in the formulation of the preferred perfume compositions of the present invention, it is counted as one single ingredient, for the purpose of defining the invention.

Nonlimiting examples of suitable fabric substantive perfume ingredients for use in the compositions of the present invention are disclosed in WO 02/18528.

(f) Chelating Agent—The compositions of the present invention may optionally comprise and preferably do comprise a chelating agent. Suitable chelating agents for use herein include nitrogen-containing, P-free aminocarboxylates such as EDDS, EDTA and DTPA; aminophosphonates such as diethylenetriamine pentamethylenephosphonic acid and, ethylenediamine tetramethylenephosphonic acid; nitrogen-free phosphonates e.g., HEDP; and nitrogen or oxygen containing, P-free carboxylate-free chelating agents such as compounds of the general class of certain macrocyclic N-ligands such as those known for use in bleach catalyst systems. Levels of chelating agents are typically lower than 5%, more typically, chelating agents, when present, are at levels of from 0.01% to 3%.

(g) Other Adjuncts—Examples of other suitable cleaning adjunct materials include, but are not limited to colors, opacifiers, anti-oxidants, bactericides, neutralizing agents, buffering agents, phase regulants, dye-transfer inhibitors, hydrotropes, thickeners, conventional (not fabric substantive) perfumes and pro-perfumes, bleaches, bleach activators, bleach catalysts, optical brighteners or fluorescers, soil release polymers, photoactivators, preservatives, germicides, fungicides, color speckles, colored beads, spheres or extrudates, sunscreens, fluorinated compounds, pearlescent agents, luminescent agents or chemi-luminescent agents, anti-corrosion and/or appliance protectant agents, alkalinity sources or other pH adjusting agents, solubilizing agents, processing aids, pigments, free radical scavengers, pH control agents, and mixtures thereof. Suitable materials include those described in U.S. Pat. Nos. 5,705,464, 5,710,115, 5,698,504, 5,695,679, 5,686,014 and 5,646,101.

Process for Preparing the Liquid Laundry Detergent Composition

The liquid laundry detergent compositions of the present invention can be prepared in any suitable manner and can, in general, involve any order of mixing or addition of the composition components.

Forms and Types of the Compositions—The liquid laundry detergent composition of the present invention may be various forms, such as liquids (aqueous or non-aqueous), pastes, and gels. Unitized dose compositions are included, in which preferably essentially non-aqueous compositions are surrounded by a, preferably, water-soluble film, as are compositions, which form two or more separate but combined dispensable portions. The liquid compositions can also be in a "concentrated" or diluted form. Preferred liquid laundry detergent compositions of the present invention include liquids, more preferably heavy duty liquid laundry detergent compositions for washing 'standard', non-fine fabrics as well as fine fabrics including silk, wool and the like. Compositions formed by mixing the provided compositions with water in widely ranging proportions are included.

For the purpose of the present invention, the composition is non-aqueous if it contains less than 15% wt., preferably between 2% to 10% wt., more preferably between 3% and 8% wt., and most preferably between 3.5% and 6% by weight of the composition, of water. This is on basis of total water by weight of the total composition.

The liquid laundry detergent compositions of the present invention may be in the form of spray compositions, preferably contained within a suitable spray dispenser. The present invention also includes products in a wide range of types such as single-phase compositions, as well as dual-phase or even multi-phase compositions. The liquid laundry detergent compositions of the present invention may be incorporated and stored in a single-, dual-, or multi-compartment bottle.

For the purpose and intent of the present invention, the compositions of the present invention have typically a pH ranging from pH 7 to pH 14, preferably between pH 7.5 and pH 11.

Method of Treating Substrates and Uses of Compositions of the Invention in Relation to Form—

The term "substrate" as used herein means a substrate, especially a fabric or garment, having one or more of the fabric care benefits described herein as imparted thereto by a composition of the present invention.

A method of treating a substrate comprising the steps of contacting the substrate with the liquid laundry detergent composition of the present invention is included in the present invention. As used herein, "liquid laundry detergent compositions" include liquid laundry detergent compositions for handwash, machine wash and other purposes including fabric care additive compositions and compositions suitable for use in the soaking and/or pretreatment of stained fabrics. In the context of this invention, contacting of fabrics with the compositions herein can include direct application of the compositions to fabrics or application of the compositions to fabrics via an aqueous wash, or fabric treatment liquor formed from such a composition. An aqueous wash, or fabric treatment liquor is formed by diluting the compositions of the present invention with a diluent, which is preferably based on water, more preferably it is water. Concentrations of the composition in such aqueous liquor will typically range from 0.01% to 10% by weight of the final aqueous liquor.

Benefits

It has been found that the liquid laundry detergent compositions of the present invention demonstrate very good cleaning performance and very good fabric care performance.

Without being bound by theory, it is believed that the incompatibility of ingredient problem of previous liquid laundry detergent compositions has arisen due to an interaction of the boron-based enzyme stabilizing system and the cationic deposition aid. By utilizing a modified cationic deposition aid as suggested by the present invention, this interaction is reduced and/or eliminated so that the liquid laundry detergent compositions of the present invention provide both a fabric cleaning benefit and a fabric care benefit. The fabric cleaning benefit is provided through the cleaning system, e.g. through a surfactant present selected from the group consisting of anionic surfactants, zwitterionic surfactants, amphoteric surfactants, nonionic surfactants, cationic surfactants, and mixtures thereof. The fabric care benefit is provided through the fabric care ingredient which is not a fabric cleaning ingredient. The fabric care benefit(s) provided via the liquid laundry detergent compositions of the present invention is an enhanced due to the presence of a modified cationic deposition aid and extend which increases the deposition rate and extend of the fabric care ingredients present.

Indeed, it has been found that these benefits are even more enhanced when compositions of the present invention are imparted to colored fabrics than to white fabrics. It is believed that the enhanced performance on colored fabrics over white fabrics is driven by enhanced deposition of the fabric care ingredient on colored fabrics than on white fabrics. Without being bound by theory, it is believed that this higher deposition rates results from an interaction between the fabric care ingredient and the dye molecules of the garment.

EXAMPLES

The following non-limiting examples are illustrative of the present invention. Percentages are by weight unless otherwise specified.

For purposes of this invention, viscosity is measured with a Carrimed CSL2 Rheometer at a shear rate of 21 $s^{-1}$.

Synthesis of Modified Polysaccharide-Based Deposition Aids

Example 1

Preparation of a Nonionically Modified Cationic Polysaccharide-Based Guar Gum Isopropyl alcohol (425 ml), distilled and deionized water (100 ml) and N-Hance 3196 Water Soluble Polymer (100.00 g) [a unmodified cationic guar gum] are placed into a 2000 ml three-necked round-bottomed flask, fitted with an anchor type mechanical stirrer, reflux condenser, internal thermometer, heating mantle and argon inlet and adjusted to a pH of 7 with acetic acid. Propylene oxide (100.00 g) is added over 5 min with stirring. Sodium hydroxide (25 ml) is added over 5 min with stirring. The mixture is heated for 4 hours with stirring at 70° C., cooled to ambient and neutralized to pH 7 with acetic acid. The water/isopropyl alcohol is removed under reduced pressure and the resulting solid is triturated first with 90:10 acetone:water followed by acetone. The solid is dried 16 h at 55° C. under reduced pressure and ground to an off white powder of gum guar 2-hydroxypropyl ether 2-hydroxy-3-(trimethylammonio)propyl ether chloride (nonionic substitution degree: 1.6 per mole; charge density 0.6 meq/g).

Example 2

Preparation of a Cationcially Modified Cationic Polysaccharide-Based Guar Gum Isopropyl alcohol (500 ml), distilled and deionized water (50 ml) and Jaguar HP-120 (50.00 g) [a unmodified cationic guar gum] are placed into a 2000 ml three-necked round-bottomed flask and fitted with an anchor type mechanical stirrer, reflux condenser, internal thermometer, heating mantle and argon inlet. Glycidyltrimethylammonium chloride (50.00 g) is added over 5 min with stirring. Sodium hydroxide (12.5 ml) is added over 5 min with stirring. The mixture is heated for 4 hours with stirring at 70° C., cooled to ambient and neutralized to pH 7 with acetic acid. The water/isopropyl alcohol is removed under reduced pressure and the resulting solid is triturated first with 90:10 acetone: water followed by acetone. The solid is dried 16 h at 55° C. under reduced pressure and ground to an of white powder of gum guar 2-hydroxypropyl ether 2-hydroxy-3-(trimethylammonio)propyl ether chloride (cationic substitution degree: 0.8 to 1.2 per mole; charge density 0.6 meq/g).

The modified polysaccharide-based deposition aids obtained by examples 1 and 2 are suitable for incorporation into the liquid detergent compositions of the present invention. When incorporating such modified polysaccharide-based deposition aids into the liquid detergent compositions of the present invention, the formation of beads resulting from the interaction of the boron-based enzyme-stabilizing system and modified cationic polysaccharide-based deposition aid is significantly reduced, preferably eliminated.

COMPOSITION EXAMPLES

Example 3

The final liquid laundry detergent composition is formulated by combining a fabric care agent and two premixes: a fabric cleaning premix A1 or A2 or A3 according to formulae A1 or A2 or A3 as below, a fabric care premix B as below, and a fabric care agent.

Fabric Cleaning Premixes A1 and A2 and A3:

| | wt % (raw materials at 100% activity) | | |
|---|---|---|---|
| | A1 | A2 | A3 |
| C13–15 alkylbenzene sulphonic acid | 13.0 | 5.5 | 5.5 |
| C12–15 alkyl ethoxy (1.1 eq.) sulphate | | 13.0 | 13.0 |
| C14–15 EO8 (1) | 9.0 | — | — |
| C12–13 EO9 (2) | — | 2.0 | 2.0 |
| C12–14 alkyl dimethyl amineoxide (3) | 1.5 | 1.0 | 1.0 |
| C12–18 fatty acid | 10.0 | 2.0 | 2.0 |
| Citric acid | 4.0 | 4.0 | 4.0 |
| Diethylene triamine pentamethylene phosphonic acid | 0.3 | — | — |
| Hydroxyethane dimethylene phosphonic acid | 0.1 | — | — |
| Ethoxylated polyethylene imine | 1.0 | 1.0 | 1.0 |
| Ethoxylated tetraethylene pentamine | 1.0 | 0.5 | 0.5 |
| Di Ethylene Triamine Penta acetic acid | — | 0.5 | 0.5 |
| Ethoxysulphated hexamethylene diamine quat | — | 1.0 | 1.0 |
| Fluorescent whitening agent | 0.15 | 0.15 | 0.15 |
| $CaCl_2$ | 0.02 | 0.02 | 0.02 |
| Propanediol | 5.0 | 6.5 | 6.5 |
| Ethanol | 2.0 | 2.0 | 2.0 |
| Sodium cumene sulphonate | 2.0 | — | — |
| NaOH | to pH 7.8 | to pH 8.0 | to pH 8.0 |
| Protease enzyme | 0.75 | 0.75 | 0.75 |
| Amylase enzyme | 0.20 | 0.20 | 0.20 |
| Cellulase enzyme | 0.05 | — | — |
| Boric acid | 2.0 | 0.3 | — |
| Na-Borate | — | — | 1.5 |
| Hydrogenated castor oil | 0.2 | 0.3 | 0.3 |
| Dye | 0.001 | 0.001 | 0.001 |
| Perfume | 0.70 | 0.70 | 0.70 |
| Water | Balance | Balance | Balance |

(1) Marlipal 1415/8.1 ex Sasol
(2) Neodol 23-9 ex Shell
(3) C12–14 alkyl dimethyl amineoxide ex P&G, supplied as a 31% active solution in water Preparation of coacervate phase forming cationic polymer solution (premix B): 5.0 g of the guar gum obtained by example 1 is added to 494.4 g of demineralized water under stirring with a normal laboratory blade mixer (type: Janke & Kunkel, IKA-Labortechnik R W 20). After 10 minutes of stirring, the pH of the mixture is brought to pH 6.5–7.0 by adding 0.62 g of 0.1M HCl. The mixture is further stirred for another 15 minutes.

Combination of the two premixes A1 & B or A2 & B or A3 & B: 50 g of premix B are added to 442.5 g of either premixes A1 or A2 or A3 and stirred for 15 minutes with a normal laboratory blade mixer.

The final liquid laundry detergent composition is formulated by adding 7.5 g of Wacker Belsil ADM1100 amino-silicone fluid to the combination of premixes A1 & B or A2 & B or A3 & B. The mixtures are stirred for 10 minutes by using a normal laboratory blade mixer as to get a good dispersion of the components.

Example 4

The final liquid laundry detergent composition is formulated by combining a fabric care agent and two premixes: a fabric cleaning premix A1 or A2 or A3 according to formulae Al or A2 or A3 as above, a fabric care premix B as above, and a fabric care agent.

Preparation of fabric care premix B (coacervate phase forming cationic polymer solution): see above as for premix B.

Combination of the two premixes A1 & B or A2 & B or A3 & B: 50 g of premix B are added to 442.5 g of either premixes A1 or A2 or A3 and stirred for 15 minutes with a normal laboratory blade mixer.

The final liquid laundry detergent composition is formulated by adding 23.4 g of PDMS 0.2 $m^2/s$ (200,000 centistokes at 20° C.) (4) fluid to the combination of premixes A1 & B or A2 & B or A3 & B. The mixtures are stirred for 10 minutes by using a normal laboratory blade mixer as to get a good dispersion of the components.

(4) Polydimethylsiloxane (PDMS) 0.2 $m^2/s$ (200,000 centistokes at 20° C.) (Dow Corning silicone 200 Fluid series).

Example 5

The final liquid laundry detergent composition is formulated by combining three premixes: a fabric cleaning premix A according to formula A3 as above and two fabric care premixes C1 and C2 as below.

1. Preparation of fabric care premix C1 (coacervate phase forming cationic polymer solution): see above as for premix B.
2. Preparation of fabric care premix C2 (amino silicone plus polydimethylsiloxane (PDMS)): 1.50 g of the amino silicone polymer fluid (General Electric® SF 1923) and 40.0 g of PDMS 0.1 $m^2/s$ (100,000 centistokes at 20° C.) (5) are mixed, using a normal laboratory blade mixer. The premix is stirred for 20 minutes.

To formulate the final liquid laundry detergent composition, 5.0 g of premix C1 is mixed with 100 g of premix A3 by using a normal laboratory blade mixer. After 10 minutes stirring, the product is stirred as to get a good vortex and 10 g of premix C2 is added via a syringe. The final composition is stirred for another 15 minutes as to get a good dispersion of the silicone component(s).

(5) Polydimethylsiloxane (PDMS) 0.1 $m^2/s$ (100,000 centistokes at 20° C.) (Dow Corning silicone 200 Fluid series).

Example 6

The final liquid laundry detergent composition is formulated by combining a fabric care agent and two premixes: a fabric cleaning premix A1 or A2 or A3 according to formulae A1 or A2 or A3 as above, a fabric care premix B as above, and a fabric care agent.

Preparation of fabric care premix B (coacervate phase forming cationic polymer solution): see above as for premix B.

Combination of the fabric care agent and premix A1 or A2 or A3: 30 g of oxidized polyethylene emulsion (ME68725 from Michelman Inc, USA at 25% active, nonionic emulsifier) are added to 442.5 g of either premixes A1 or A2 or A3 and stirred for 15 minutes with a normal laboratory blade mixer.

The final liquid laundry detergent composition is formulated by adding 50 g of the premix B to the combined fabric care agent with either premix A1 or A2 or A3. The mixtures are stirred for 10 minutes by using a normal laboratory blade mixer as to get a good dispersion of the components.

The liquid laundry detergent compositions of composition examples 3 to 6 all demonstrate excellent product stability as fully formulated composition as well as in diluted form during a laundering cycle. The formation of beads resulting from the interaction of the boron-based enzyme-stabilizing system and the cationic polysaccharide-based deposition aids is significantly reduced, preferably eliminated when utilizing the modified cationic polysaccharide-based deposition aids in combination with the boron-based enzyme-stabilizing system in the compositions of the present inventions.

The liquid laundry detergent compositions of composition examples 3 to 6 all provide excellent fabric cleaning and fabric care performance when added to the drum of an automatic washing machine wherein fabric are there and thereinafter laundered in conventional manner.

The compositions of examples 3, 4 and 6 are particularly advantageous with respect to color care benefits imparted to fabrics treated therewith. The compositions of examples 3, 4 and 6 are also particularly advantageous with respect to fabric softening benefits imparted to fabrics treated therewith; this is especially true for colored fabrics on which the observed fabric softening benefits are even more enhanced in comparison to the fabric softening benefits provided onto white fabrics. The compositions of examples 3, 4 and 6 are also advantageous with respect to anti-abrasion benefits and to anti-pilling benefits provided for fabrics treated therewith.

What is claimed is:

1. A liquid, laundry detergent composition, the composition comprising (a) at least one surfactant selected from the group consisting of anionic surfactants, zwitterionic surfactants, amphoteric surfactants, nonionic surfactants, cationic surfactants, and mixtures thereof;

(b) at least one enzyme and an enzyme stabilizing system comprising boron;

(c) at least one fabric care ingredient which is not a fabric cleaning ingredient; and (d) at least one modified cationic deposition aid for the fabric care ingredient wherein the cationic deposition aid is a natural or synthetic polysaccharide derived from galactomannoses.

wherein prior to modification, the cationic deposition aid has at least one pair of cis-hydroxy groups, and wherein the cationic deposition aid is modified in such a way that the enzyme stabilizing system does not exhibit cis-hydroxy group interaction with the cationic deposition aid.

2. A laundry detergent composition according to claim 1 wherein the cationic deposition aid is a natural or synthetic polysaccharide having cis-hydroxy groups, wherein on average at least one hydrogen atom per pair of cis-hydroxy groups is at least partly or completely substituted with a cationic substituent or with a nonionic substituent.

3. A laundry detergent composition according to claim 1 wherein the cationic substituent have the formulas (1) or (2) as below:

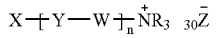

(1)

wherein X and W are the same or different and are independently selected from the group consisting of substituted or unsubstituted alkylene, substituted or unsubstituted alkenylene, substituted or unsubstituted alkynylene, substituted or unsubstituted arylene, or combinations thereof;

Y=O, S, Se, or Te;

n=O to 100;

wherein all three R groups are the same or different and are independently selected from the group consisting of substituted or unsubstituted alkyl, substituted or unsubstituted alkenyl, substituted or unsubstituted alkinyl, substituted or unsubstituted aryl, substituted or unsubstituted hydroxyalkyl, substituted or unsubstituted alkyloxyalkyl, substituted or unsubstituted alkyloxyhydroxyalkyl, substituted or unsubstituted amine, or combinations thereof; and Z=F, Cl, Br, I, alkyl sulfate, alkyl carboxylate, or combinations thereof; or,

X-T (2)

wherein X is defined as above, and T is a cationically charged cyclic substituent, comprising at least one quaternized nitrogen atom and wherein T is selected from the group consisting of substituted and unsubstituted quaternized imidazole, substituted and unsubstituted quaternized piperazine, substituted and unsubstituted quaternized pyrrole, substituted and unsubstituted quaternized pyrroline, substituted and unsubstituted quaternized pyrrolidine, substituted and unsubstituted quaternized pyridine, substituted and unsubstituted quaternized pyrimidine, substituted and unsubstituted quaternized dihydropyrrole, substituted and unsubstituted quaternized thiazole, substituted and unsubstituted quaternized thiadiazine, substituted and unsubstituted quaternized pyrazole, substituted and unsubstituted quaternized imidazole, substituted and unsubstituted quaternized oxazole, substituted and unsubstituted quaternized isoxazole, substituted and unsubstituted quaternized isothiazole, substituted and unsubstituted quaternized triazole, substituted and unsubstituted quaternized tetrazole, substituted and unsubstituted quaternized piperidine, substituted and unsubstituted quaternized pyridazine (1,2-; 1,3-,1,4-isomer), substituted and unsubstituted quaternized triazine, and mixtures thereof.

4. A laundry detergent composition according to claim 2 wherein the nonionic substituent has the formula:

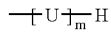

wherein U is selected from the group consisting of substituted or unsubstituted alkylene, substituted or unsubstituted alkyleneoxy, substituted or unsubstituted alkenylene, substituted or unsubstituted alkynylene, substituted or unsubstituted arylene, substituted or unsubstituted aryleneoxy, or combinations thereof; and m=1 to 100.

5. A laundry detergent composition according to claim 2 wherein (i) the degree of substitution of the cationically substituted hydrogen atom is on average from 0.01 to 1.0;

(ii) the degree of molar substitution of the nonionically substituted hydrogen atom is on average from 0.1 to 5.0.

6. A laundry detergent composition according to claim 2 wherein the cationic deposition aid is selected from the group consisting of hydroxyalkyl guar hydroxyalkyl trimonium salts, derivatives, and mixtures thereof.

7. A laundry detergent composition according to claim 1 wherein the cationic deposition aid has a charge density of from 0.1 to 5.0 meq/g.

8. A laundry detergent composition according to claim 1 wherein the cationic deposition aid has a molecular weight of from 5,000 to 10,000,000 g/mol.

9. A laundry detergent composition according to claim 1 wherein the surfactants are present at a concentration from 1.0% to 80% by weight of the composition.

10. A laundry detergent composition according to claim 1 wherein the enzymes are present at a concentration from 0.0001% to 10% by weight of the composition.

11. A laundry detergent composition according to claim 1 wherein the boron-based enzyme-stabilizing system comprises boric acid and/or salts thereof, and wherein the boron-based enzyme stabilizing system is present at concentrations from 0.01% to 10% by weight of the composition, expressed as boric acid.

12. A laundry detergent composition according to claim 1 wherein the fabric care ingredients are present at a concentration from 0.01% to 30% by weight of the composition.

13. A laundry detergent composition according to claim 1 wherein the modified cationic deposition aids are present at a concentration from 0.001% to 10% by weight of the composition.

14. A laundry detergent composition according to claim 1 wherein the enzyme is selected from the group consisting of peroxidases, proteases, gluco-amylases, amylases, xylanases, cellulases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, dextranase, transferase, laccase, mannanase, xyloglucanases, derivatives thereof, and mixtures thereof.

15. A laundry detergent composition according to claim 1 wherein the fabric care ingredient is selected from the group consisting of clays, silicon-free amine compounds, silicon-free quaternary ammonium based compounds, nitrogen-free silicone polymers, amino silicone polymers, anionic silicone polymers, cationic silicone polymers, polyolefins, and mixtures thereof.

16. A laundry detergent composition according to claim 1, further comprising at least one compound selected from the group consisting of liquid carriers; builders; suds suppressors; stabilizers; perfumes; chelating agents; colors; opacifiers; anti-oxidants; bactericides; neutralizing agents; buffering agents; phase regulants; dye-transfer inhibitors; hydrotropes; thickeners; conventional (not fabric substantive) perfumes and pro-perfumes; bleaches; bleach activators; bleach catalysts; optical brighteners or fluorescers; soil release polymers; photoactivators; preservatives; germicides; fungicides; color speckles; colored beads; spheres or extrudates; sunscreens; fluorinated compounds; pearlescent agents; luminescent agents or chemi-luminescent agents; anti-corrosion and/or appliance protectant agents; alkalinity sources or other pH adjusting agents; solubilizing agents; processing aids; pigments; free radical scavengers; pH control agents; and mixtures thereof.

17. A laundry detergent composition according to claim 1 wherein the composition is a liquid laundry detergent composition being essentially non-aqueous, or a liquid laundry detergent composition being essentially non-aqueous and wrapped by a film.

18. A laundry detergent composition according to claim 17 wherein the film is a water-soluble film.

19. A liquid, laundry detergent composition, the composition comprising (a) from 10% to 50%, by weight of the composition, of at least one surfactant selected from the group consisting of anionic surfactants, zwitterionic surfactants, amphoteric surfactants, nonionic surfactants, cationic surfactants, and mixtures thereof;

(b) from 0.001% to 2.5%, by weight of the composition, of at least one enzyme and from 0.1% to 3.0%, by weight of the composition, expressed as boric acid, of an enzyme stabilizing system comprising boron;

(c) from 0.5% to 5.0%, by weight of the composition, of at least one fabric care ingredient which is not a fabric cleaning ingredient; and (d) from 0.1% to 2.5%, by weight of the composition, of at least one modified cationic deposition aid for the fabric care ingredient, wherein the cationic deposition aid is a natural or synthetic polysaccharide derived from galactomannoses, wherein prior to modification, the cationic deposition aid has at least one pair of cis-hydroxy groups, wherein the cationic deposition aid is modified in such a way that the enzyme stabilizing system does not exhibit cis-hydroxy group interaction with the cationic deposition aid, and wherein the cationic deposition aid has a charge density of from 0.2 to 2.0 meq/g.

20. A method for providing fabric cleaning benefits, reduction of wrinkle benefits, prevention of wrinkle benefits, removal of wrinkle benefits, fabric softening benefits, fabric feel benefits, garment shape retention benefits, elasticity benefits, ease of ironing benefits, perfume benefits, color care benefits, anti-abrasion benefits, anti-pilling benefits or any combination thereof to fabrics, which method comprises treating the fabric with a treating medium formed from the liquid laundry detergent composition according to claim 1.

21. A method according to claim 20 wherein the fabrics are colored fabrics.

22. A method for treating a substrate comprising contacting the substrate with a treating medium formed from the liquid laundry detergent composition according to claim 1 such that the substrate is treated.

* * * * *